US009811968B1

(12) United States Patent
Odom et al.

(10) Patent No.: US 9,811,968 B1
(45) Date of Patent: Nov. 7, 2017

(54) SYSTEM AND DEVICE FOR CONDUCTING WAGERING GAMES WITH A CONTINUOUSLY MODIFIED MAP

(71) Applicants: Wayne Odom, Tucson, AZ (US); Karolyn Gee, Tucson, AZ (US)

(72) Inventors: Wayne Odom, Tucson, AZ (US); Karolyn Gee, Tucson, AZ (US)

( * ) Notice: Subject to any disclaimer, the term of this patent is extended or adjusted under 35 U.S.C. 154(b) by 0 days.

(21) Appl. No.: 15/638,420

(22) Filed: Jun. 30, 2017

Related U.S. Application Data

(63) Continuation-in-part of application No. 15/220,357, filed on Jul. 26, 2016.

(51) Int. Cl.
*A63F 9/24* (2006.01)
*G07F 17/32* (2006.01)
*G07F 17/34* (2006.01)

(52) U.S. Cl.
CPC ..... *G07F 17/3211* (2013.01); *G07F 17/34* (2013.01)

(58) Field of Classification Search
CPC ..... G07F 17/32; G07F 17/3286; G07F 17/34; G07F 17/3227
USPC ..... 463/16–20, 25
See application file for complete search history.

(56) References Cited

U.S. PATENT DOCUMENTS 6,796,903 B1 * 9/2004 Bryant ..... G07F 17/3244 273/139
7,425,178 B1 * 9/2008 Odom ..... A63F 3/081 463/16
2009/0325670 A1 * 12/2009 Kelly ..... G07F 17/32 463/20
2010/0113137 A1 * 5/2010 Miller ..... G07F 17/3262 463/21
2012/0190436 A1 * 7/2012 Miller ..... G07F 17/32 463/25
2012/0202579 A1 * 8/2012 Olsen ..... G07F 17/3258 463/20
2014/0087833 A1 * 3/2014 Berman ..... G07F 17/3267 463/20
2015/0356814 A1 * 12/2015 Wright ..... G07F 17/34 463/11
2017/0213415 A1 * 7/2017 Nakamura ..... G07F 17/3213

* cited by examiner

*Primary Examiner* — Michael Cuff
(74) *Attorney, Agent, or Firm* — Robert Ryan Morishita; Morishita Law Firm, LLC

(57) ABSTRACT

A system and electronic game machine that store a map of game event outcomes correlated to possible signals received at a logic controller. Multiple sequential game event outcomes are generated using the map, with the map modified so that previously produced game event outcomes are unavailable in the modified map. The logic controller monitors for a triggering element and, upon detecting a triggering element, the map is restored by re-mapping the unavailable game event outcomes back into the map.

20 Claims, 4 Drawing Sheets

SYSTEM AND DEVICE FOR CONDUCTING WAGERING GAMES WITH A CONTINUOUSLY MODIFIED MAP

RELATED APPLICATION DATA

This application is a continuation-in-part of U.S. patent application Ser. No. 15/220,357, entitled "System and Device for Conducting Wagering Games with a Continuously Modified Map," filed Jul. 26, 2016, by Applicants herein.

FIELD OF THE INVENTION

The present invention relates to systems and devices used to conduct games. More specifically, the present invention includes embodiments of systems and devices for conducting wagering games in which the map of game event outcomes may be modified to make previously-produced game event outcomes unavailable.

BACKGROUND OF THE INVENTION

There are many known casino games using decks of playing cards or other sets of game indicia to determine the outcome of the game. For example, many casino games of chance utilize reels displaying a fixed set of reel symbols which, when obtained in certain predetermined combinations, may trigger an award. These reel games are commonly referred to as reel slot machines or slot machines.

Slot machines can contain any number of reels, although most slot machines contain three, four, or five reels, and any number of pay lines, although most slot machines include one, three, five, eight, or nine pay lines. For example, in some slot machine games, each reel on a slot machine may index at a plurality of positions or stops, each of which contains a symbol or a blank. While the number and location of index positions can vary from game to game, within any particular game, the number and location of index positions are fixed. Slot games are usually differentiated by the award tables and winning symbol combinations, but slot games are otherwise virtually identical to one another.

Purely mechanical slot machines operated by stopping spinning reels with a mechanical brake to determine the outcome of the game. These mechanical machines were limited in two ways. First, the odds of any particular symbol combinations was constrained by the number of reels and the number of symbols per reel. For example, in a slot machine with three reels having ten symbols per reel, the odds of each combination appearing are 1:1,000 (i.e., $10\times10\times10=1{,}000$). To vary the odds (and thus the payouts that could be issued for the particular combination) the quantity of each type of symbol may differ. For example, a ten symbol reel strip may include five cherries, four grapes, and one lemon. In an example using three such reels, the odds of obtaining three lemons would be 1:1,000, whereas the odds of obtaining three cherries is 125:1,000. In such an example, the greatest payout that could be paid while maintaining a house edge (i.e., a statistical expectation of profit) would be 999 to one for three lemons, thereby guaranteeing that the house wins one coin when a payout is paid for three lemons.

Modern slot machines, whether video or mechanical are controlled via computer and are not so constrained. In Telnaes, U.S. Pat. No. 4,448,419, a fixed digital map is created with all possible symbol combinations within a game mapped to random numbers that may be generated by a random number generator ("RNG"). Telnaes teaches, however, that combinations may be duplicated within the fixed map. Thus, the losing combination of BAR-7-(blank) may be mapped to thousands or tens of thousands or hundreds of thousands of random numbers. Because the likelihood of each combination is not limited by the physical quantity of reel stops (i.e., the quantity of symbols printed on each reel strip) but rather the quantity of random numbers, the manufacturer has total control over the odds of any particular symbol combination occurring. For example, an RNG may be configured to generate one million possible numbers with losing combinations mapped to 999,999 of the possible random numbers and a winning combination mapped to one of the possible random numbers. In such an example, the odds of obtaining a winning combination would be 1:1,000,000 whether each reel strip has one or ten or one hundred reel stops. Using such a fixed map, the display of the reels is merely a way to visually report the outcome of the game, rather than determine the outcome of the game. That is, in such a slot machine, the outcome is determined by the RNG generating a random number and a logic controller using the fixed map to determine the outcome mapped to that random number. The display (whether a computer-generated graphical display or physical reels controlled by stepper motors) is then controlled by the logic controller to display the symbol combination mapped to the random number generated according to the fixed map.

The benefit of using a fixed map is that the virtual reels (as opposed to physical reels) permit payouts that are not constrained by the size (i.e., quantity of reel stops) of the reels. This means that large payouts can be offered by creating a fixed map that has certain outcomes mapped to only a few possible random numbers, independent of the quantity of reels, reel symbols, or reel stops.

Outwardly, a slot game appears to operate as follows: a wager is received to initiate the slot machine. Often, games are structured so that multi-coin wagers are allocated between the number of paylines activated and the number of coins per payline. For example, a 45 coin wager may be allocated with five coins wagered on each of nine paylines.

A "spin" button is actuated on the player interface. Outwardly, actuation of the spin button appears to cause the reels to spin and, upon stopping, determine the symbol combination making up the game outcome. Inwardly, however, actuation of the spin button causes the RNG to randomly select a number. The slot machine's logic controller uses the fixed map to "look up" the outcome mapped to the random number selected. The logic controller then controls the display (again, it is irrelevant whether the slot machine utilizes a video display or mechanical reels) to display the outcome mapped to the random number selected. The logic controller issues a payout, if any, associated with the outcome mapped to the random number selected according to a fixed paytable.

As may be appreciated, the use of mapping has been applied to all modern gaming machines, regardless of how the game is conducted or displayed. That is, whether the game utilizes cards, tiles, numbers, or any other game indicia, mapping is used to translate the output of an RNG into an outcome, which the logic controller can then display visually at a display.

SUMMARY OF THE INVENTION

Various embodiments of the present invention are directed to a system and device directed to conducting a game. That is, the present invention is not directed to the game itself, but rather to a system and device for improving the conduct of a game. Optionally, the game is conducted at an electronic game machine including a logic controller in communication with a data storage device, a display, and a player interface that is configured to receive input and transmit the input to the logic controller. The electronic game machine is configured to conduct a plurality of game events, where each game event is capable of producing at least one game event outcome from a plurality of possible game event outcomes. A game event may take any form, including: a base game; an element of a base game which, with other game events, makes up a base game; a bonus event for a base game; a secondary game associated with a base game; or the like. As may be appreciated, the game event and game event outcomes may be based around any type of game content, including games of chance (such as playing card games, tile games, reel slot games, bingo or keno games, dice games, wheel games, or the like), games of skill, hybrid games of skill and chance, or any other type of game.

The data storage device is configured to store in non-volatile memory a map containing a plurality of possible signals capable of being received at the logic controller correlated to the possible game event outcomes. In one optional embodiment, the signal could comprise input received through the player interface and transmitted to the logic controller, such as input representing the skill, strategy, knowledge, or dexterity of the player in a skill-based game or hybrid skill/chance game. In another optional embodiment, the electronic game machine includes a random number generator (whether hardware, software, firmware, or the like) in communication with the logic controller. In one such optional embodiment, the signal could comprise a random number generated by the random number generator and transmitted to the logic controller such as that utilized in a game of chance.

The data storage device also stores program instructions executable by the logic controller. In one optional embodiment, the program instructions control the electronic game machine to receive a wager through the player interface. A game event is conducted by the logic controller to produce a game event outcome. Optionally, the game event is conducted in response to at least (a) the receipt of the wager and (b) a signal received at the logic controller from the plurality of possible signals. As noted above, the possible signals could come from a random number generator, a player interface, or the like. A game event outcome is produced by selecting the game event outcome correlated to the signal received according to the map stored at the data storage device. The wager is resolved by the logic controller based on the game event outcome(s) produced.

The map is modified by making each the game event outcome produced unavailable from the plurality of possible game event outcomes according to the map stored at the data storage device. In one optional embodiment, the map may be modified by de-mapping the game event outcome(s) produced to make the at least one game event outcome produced unavailable to be produced. In another optional embodiment, the map may be modified by restructuring the map such that the signal correlated the game event outcome(s) produced becomes correlated to a different game event outcome. Optionally, a record is stored at the data storage device of each game event outcome made unavailable in the modified map. In an alternate or additional optional embodiment, a record is stored at the data storage device of each game event outcome remaining in the modified map. In an optional embodiment, the record of game event outcomes made unavailable (and/or the game event outcomes remaining) in the modified map may be displayed at the display.

At least one additional wager is received through the player interface after modifying the map stored at the data storage device. In one optional embodiment, wagers are selected from a plurality of wager denominations and the additional wager is constrained to be of the same wager denomination as the original wager. In an alternate or additional optional embodiment, the additional wager is constrained to be less than, or equal to, a predefined multiple of the original wager. For example, in one such optional embodiment, the additional wager is constrained to be equal to the original wager.

At least one additional game event is conducted to produce an additional game event outcome using the modified map. The additional wager is resolved based on the additional game event outcome produced using the modified map.

In an optional embodiment, the program instructions may further include detecting a triggering element and re-mapping the map to include previously excluded game event outcomes within the map in response to detection of the triggering element. In one optional embodiment, the triggering element may be the production of a specified game event outcome. In another optional embodiment, the triggering element may be receipt of input through the player interface. In yet another optional embodiment, the triggering element may be production of a specified quantity of game event outcomes. In yet another optional embodiment, the triggering element is the unavailability of a specified quantity of game event outcomes.

The present invention also includes a system configured to conduct a plurality of game events, where each game event is capable of producing at least one game event outcome from a plurality of possible game event outcomes. The system includes a network device configured to store in non-volatile memory a map containing a plurality of possible signals correlated to the possible game event outcomes. An electronic game machine in communication with the network device includes a logic controller, a display, a data storage device, and a player interface in communication with the logic controller. The player interface is configured to receive input and transmit the input to the logic controller.

The data storage device is configured to store program instructions executable by the logic controller. In an optional embodiment, a wager is received through the player interface, which may include an input device and a conventional hardware-based wager acceptor. A game event is conducted to produce a game event outcome. In an optional embodiment, the game event is conducted in response to at least (a) the receipt of the wager and (b) a signal received at the logic controller from the plurality of possible signals. The game event outcome is produced by selecting the game event outcome correlated to the signal received according to the map stored at the network device. In one optional embodiment, the signal may consist of input received through the player interface and transmitted to the logic controller. In another optional embodiment, the electronic game machine may include a random number generator in communication with the logic controller, and the signal may consist of a random number generated by the random number generator and transmitted to the logic controller. The wager is resolved based on the game event outcome produced.

The map is modified by making each game event outcome produced unavailable from the plurality of possible game event outcomes according to the map stored at the network device. In one optional embodiment, the map may be modified by de-mapping the game event outcome(s) produced, thereby making the game event outcome(s) produced unavailable to be produced again. In another optional embodiment, the map may be modified by restructuring the map such that the signal correlated the at least one game event outcome produced becomes correlated to a different game event outcome.

At least one additional wager is received after modifying the map stored at the network device. In one optional embodiment, wagers are selected from a plurality of wager denominations and the additional wager is constrained to be of the same wager denomination as the original wager. In an alternate or additional optional embodiment, the additional wager is constrained to be less than, or equal to, a predefined multiple of the original wager. For example, in one such optional embodiment, the additional wager is constrained to be equal to the original wager.

At least one additional game event is conducted to produce an additional game event outcome using the modified map. The additional wager is resolved based on the additional game event outcome produced using the modified map. Optionally, a record is stored at the data storage device of each game event outcome made unavailable in the modified map. In an alternate or additional optional embodiment, a record is stored at the data storage device of each game event outcome remaining in the modified map. In an optional embodiment, the record of game event outcomes made unavailable (and/or the game event outcomes remaining) in the modified map may be displayed at the display.

In an optional embodiment, the program instructions may include detecting a triggering element and re-mapping the map stored at the network device to include previously excluded game event outcomes within the map in response to detection of the triggering element. In one such optional embodiment, the triggering element may be the production of a specified game event outcome. In another such optional embodiment, the triggering element may be receipt of input through the player interface. In yet another such optional embodiment, the triggering element may be production of a specified quantity of game event outcomes. In yet another such optional embodiment, the triggering element may occur when a specified quantity of game event outcomes have been made unavailable.

DESCRIPTION

Figure 1:
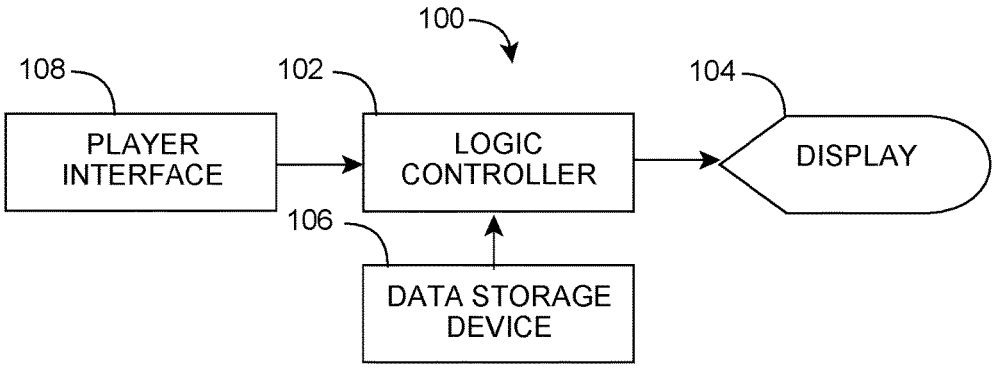
FIG. 1 is a block diagram of a device according to an embodiment of the present invention.
Figure 2:
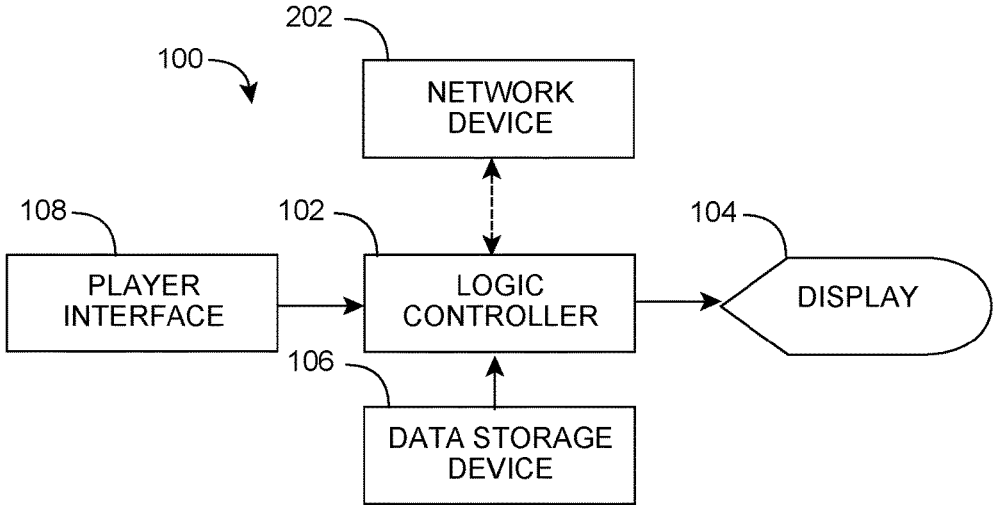
FIG. 2 is a block diagram of a system according to an embodiment of the present invention.

Reference is now made to the figures wherein like parts are referred to by like numerals throughout. As shown in FIGS. 1 and 2, the present invention is a system and device for conducting a wagering game. The present method could be implemented in a gaming machine, live game, PDA, handheld gaming device, cellular telephone, personal computer, tablet device or the like and may be conducted in a standalone device or multiple devices communicating via computer network, Internet, or the like.

The present method is directed for use in conducting game events. A game event could take any form, including a base game, a component of a base game, a bonus game, a component of a bonus game, or the like. According to the present invention, multiple sequential or simultaneous game events are conducted by a system or device using a continuously modified map. For example, it is contemplated that multiple game events could occur within a single base game (e.g., multiple turns or moves within a single game), across a base game and a bonus game (e.g., one or more game events occur within a base game which lead to one or more game events in a bonus game), within a single bonus game (e.g., multiple turns or moves within a single bonus game), across multiple base games (e.g., multiple hands across multiple base games), across multiple bonus games (e.g., multiple hands across multiple base games), or any combination thereof.

In this regard, it is noted that the present method could be used in conjunction with any type of game. Moreover, it is contemplated that the game may be a game of skill (e.g., darts, ring toss, or the like), a game of chance (e.g., slots, baccarat, keno, bingo, or the like), or a hybrid game (e.g., poker, blackjack, pai gow, or the like). In this regard, the player interface included in a device or system according to the present invention may include an input device for receiving input (whether skill-based or not) and transmitting it to a logic controller. It is noted that these examples merely illustrate how the present method could be applied to various game events and should not be considered restrictive, since the present method could be adapted to any game event, whether the game event outcome is compared to a standard (such as a paytable), a dealer outcome, one or more other player outcomes, the player's own outcomes, or the like.

The game event may include single player or multi-player games.

A system and device according to the present invention is configured for game logic that conducts multiple sequential or simultaneous game event outcomes. In this regard, the game logic for conducting game events and generating game event outcomes is separate and independent from the present invention which continuously modifies a map as a result of, but utilizing logic separate from, the game logic. Because of the independence between the present invention and the game logic, the present invention may be applied to any game logic, including as a retrofit for existing game logic. Conceptually, embodiments of the present invention reside between the random number generator ("RNG") and the game logic, such that signals from the RNG are first passed through the logic of the present invention to modify the map and return a result to the game logic based on the modified complete map as described in greater detail below. Turning to FIGS. 1 and 2, the present invention is directed to a device and system. In one such optional embodiment illustrated in FIG. 1, a logic controller 102 communicates with a display 104, a data storage device 106, and a player interface 108.

In an optional embodiment, the data storage device 106 is non-volatile memory. In one such optional embodiment, a data storage device 106 stores a map of possible signals capable of being received at the logic controller 102 correlated to possible game event outcomes in the game.

Figure 4:
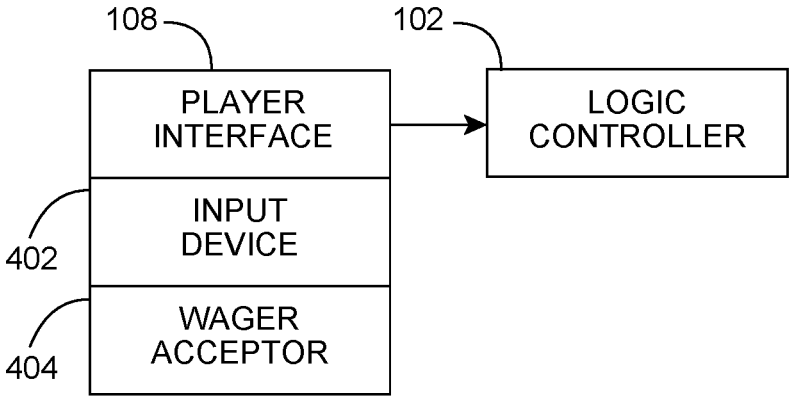
FIG. 4 is a block diagram of a device according to an embodiment of the present invention.

In an optional embodiment illustrated in FIG. 4, the player interface 108 may include an input device 402 and a wager acceptor 404. In one such optional embodiment, the input device 402 may include a touchscreen, button or button panel, stylus, keyboard, keypad, or the like to receive input and communicate the input to the logic controller 102. Similarly, in an optional embodiment, the wager acceptor 404 could include any means for accepting a wager including a "BET" button or other button to allocate stored credits or credits in a connected account, a currency or bill acceptor, a magnetic or radio frequency identification ("RFID") card reader, contactless payment such as near-field communication ("NFC"), magnetic secure transmission ("MST"), or the like, or any other hardware device for accepting a wager.

Returning to FIGS. 1 and 2, in an optional embodiment in which the game is a skill-based or hybrid game, the mapped signals may include input (e.g., skillful input) received through the player interface 108, such as the signal from a controller, button, touchscreen, joystick, directional pad, or the like, and transmitted to the logic controller 102. For example, in an optional embodiment directed to a skill-based or hybrid game, an input directing a particular action (such as pulling a trigger at the coordinates (25, 72)) may be mapped to a particular game event outcome (such as striking the bulls-eye on a first target).

In an optional embodiment in which the game is a game of chance, the mapped signals may be random numbers generated by an RNG and transmitted to a logic controller 102. It is contemplated that the RNG may be hardware, software, firmware, or any other form. In one such example embodiment directed to a game of chance, a random number generator may generate a random number (such as a number between 1 and 1,000,000) with each of the possible random numbers mapped to a particular game event outcome (such as the possible winning and losing symbol combinations displayed across the reels of a slot machine). For example, the number 1,240 may be mapped to the game event outcome of 7-7-7 displayed on the reels of a three-reel slot machine.

In an optional embodiment are directed to a game using physical objects, the mapped signals may include the identity and location of the physical objects, such as a map of the location and identity of playing cards stored in a shoe or card shuffler. For example, in an optional embodiment in which a security shuffler/shoe is used, a camera recognizes the identity of each playing card within a stack and a map is created of the location (or order) of the playing cards. In such an optional embodiment, for example, the location six positions from the top of the stack may be mapped to the Jack of diamonds playing card.

In an optional embodiment, the data storage device 106 may also store parameters and files used to conduct the game, such as pay tables and sound files. In an optional embodiment in which the display 104 is a video display rather than a mechanical display, the data storage device 106 may store graphics files. It is contemplated that the data storage device 106 may be fixed or removable from the electronic game machine 100.

Alternatively or additionally, as illustrated in FIG. 2, it is contemplated that the map may be remote from the electronic game machine 100, such as at a server or other network device 202 as illustrated in FIG. 2. In such an optional embodiment, the electronic game machine 100 communicates with the network device 202 via a local area network, wide area network, the Internet, virtual private network, or the like.

Figure 3:
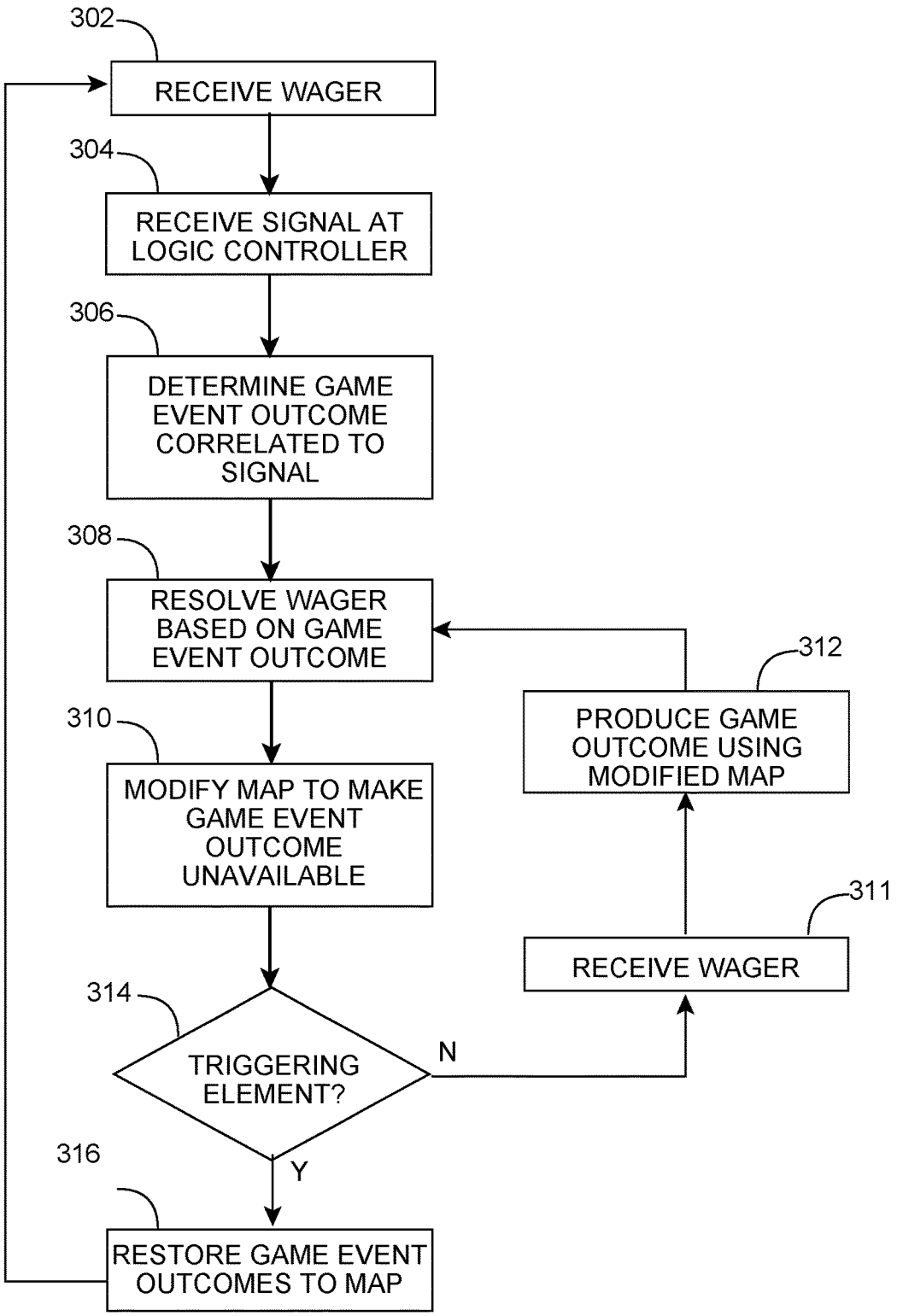
FIG. 3 is a flow chart of a method according to an embodiment of the present invention.

The data storage device 106 stores program instructions executable by the logic controller 102 to operate the device and/or system. Referring generally to FIG. 3, a wager is received 302. In an optional embodiment, a wager may be received for each game event outcome. These wagers may be received together or separately as each game event is conducted. Optionally, the wager may be controlled in that the player's options for altering a wager and/or wager denomination between game events may be limited. This is described in greater detail below.

Continuing with FIG. 3, a signal is received 304 at the logic controller 102. A game event outcome is produced by determining 306 the game event outcome correlated to the signal received according to the map. In an optional embodiment, the game event outcome is determined solely by the correlation between the signal (which, as discussed above, may come from the player interface, an RNG, or the like) and the game event outcome according to the map. The logic controller 102 may control the display 104 to display the game event outcome after the game event outcome is determined, such as by displaying cards being dealt to a hand, reels spinning and indexing at certain reel stops, a target being hit, or the like. But it should be understood that the signal and the map determine the game event outcome and the display of the game event outcome occurs only after the determination of the game event outcome.

In an initial game event, a game event outcome may be produced using a complete map, that is, a map including all possible signals and all possible game event outcomes. Subsequent game event outcomes, discussed in greater detail below, may be produced using a modified map in which previously produced game event outcomes are made unavailable on the map. That is, after a game event outcome is produced, it is made unavailable on the map.

For example, in an embodiment in which the map includes a single deck of playing cards, a game event outcome of K♡ 2♢ A♢ A♧ 7♤ would mean that these cards are made unavailable on the map and, thus, there are no King of hearts, two of diamonds, Ace of diamonds, Ace of clubs, or seven of spades available for subsequent game event outcomes.

With continued reference to FIG. 1, the wager staked on the game is resolved 308 based on the game event outcome produced. In one such optional embodiment, game event outcomes include winning game event outcomes and losing game event outcomes, with an award issued for winning game event outcomes and the wager being retained or collected for losing game event outcomes.

The map is modified 310 to make the game event outcome produced in the game event unavailable on the map. In one optional embodiment, the game event outcome is made unavailable by de-mapping the game event outcome such that the game event outcome cannot be selected. For example, the signal correlated with the de-mapped game event outcome could point to a blank, i.e., no game event outcome, so that another signal would need to be received to produce another game event outcome. In another optional embodiment, the map is restructured so that the signal correlated with the de-mapped game event outcome is redirected to a different game event outcome. In either case, the map is modified for, and used 312 in, subsequent game events so that previously-produced game event outcomes are unavailable to be produced in the next or subsequent game event. In this sense, each game event is independent because each game event outcome is produced using a unique map. In this manner, game event outcomes are cumulatively made unavailable on the map until re-mapping is triggered in which previously game event outcomes that were previously made unavailable are reintroduced into the map.

As game event outcomes are made unavailable on the map, a record may be maintained of the unavailable game event outcomes and/or the game event outcomes remaining. In one optional embodiment, the record is stored internally.

For example, in one optional embodiment, the cumulative record of unavailable game event outcomes (or the game event outcomes remaining after each game event) forms a history of the game events. In one such optional embodiment, the history may also include the wager size and/or wager denomination. As discussed above, such a record may be used to constrain the size and/or denomination of wagers in subsequent game events until a re-mapping occurs.

In an optional embodiment, a display may be generated of the unavailable game event outcomes or the game event outcomes remaining available. In one such optional embodiment, the display 104 includes a display of the game event outcomes remaining (or conversely a display of the unavailable game event outcomes). In alternate optional embodiments, the display may include the winning game event outcomes made unavailable as a result of being produced previously (or conversely by displaying only the winning game event outcomes available within the map) or losing game event outcomes made unavailable as a result of being produced previously (or conversely by displaying only the losing game event outcomes available within the map). In other optional embodiments, a graphic illustrating the relative quantity of game event outcomes remaining in the map without specifically identifying the game event outcomes remaining in the map may be displayed. For example, in one such optional embodiment, a deck of cards, shoe of cards, hopper of balls, or other graphical representation of the inventory of the map may be displayed. As game event outcomes are made unavailable, i.e., as game event outcomes are produced and the map is modified, the graphical representation may change to illustrate that the quantity of remaining game event outcomes has shrunk without specifically identifying the game event outcomes remaining in the map (or the game event outcomes made unavailable on the map). Such a graphical representation could include, for example, a deck of cards or shoe of cards shrinking in size, a hopper of balls containing fewer balls, or the like.

In another optional embodiment, the player may be notified of the depletion of game indicia from the finite set by displaying the quantity of game event outcomes remaining before re-mapping. For example, in one optional embodiment, a display may inform the player that a certain number of games have been played or that a certain number of games remain until a re-mapping. In an additional or alternative optional embodiment, a display may inform the player that a certain quantity of game event outcomes remain before a re-mapping. In either case, the player is notified that game event outcomes have been, and are being, excluded from the map as play is conducted which enables a player to determine the constitution of the map if the player chooses to use that information. For example, a player who begins with a full map and sees that fifteen games remain until a re-mapping, the player is able to, at any point, determine the state of the map. In this manner, an element of memory and skill is introduced into an game that is otherwise a game of chance.

In yet another optional embodiment, a display notifies the player of the original constitution of the map and identifies when a re-mapping will occur. For example, a display may state that the map includes six poker decks and that the cards are made unavailable until one hundred cards remain, at which point the unavailable cards are re-mapped into the map. In this manner, the player is aware that cards are excluded as play is conducted, which enables the player to determine the remaining constitution of the map if he or she so chooses.

The cumulatively modified map is used 312 in subsequent games until a re-mapping occurs to reintroduce the game event outcomes made unavailable back into the map. That is, wagers are received 311 and subsequent games are conducted using 312 the modified map. It is noted that in an optional embodiment, the size of the wager in the subsequent games may be controlled. For example, the player may be restricted in the amount by which the player can increase the wager. That is, in an optional embodiment, the bet spread, i.e. the spread between the minimum wager and the maximum wager, may be different in the subsequent games using the modified map than in a hand played with the complete map. In a further optional embodiment, players may not be permitted to increase the wager at all during the additional games. Rather, the player of such an optional embodiment would only be permitted to increase the player's wager in a game following a re-mapping. In other words, in such an embodiment, a player may increase the player's wager (or permitted bet spread) only when the map is restored of all the unavailable game event outcomes.

In this regard, it is also contemplated that the present invention may be adapted to a game in which multiple wager denominations are established. In an optional embodiment of such a multi-denomination game, the player may be restricted in changing denominations in that the player of such an optional embodiment would only be permitted to change the player's wager denomination in a game following a re-mapping. That is, as above, in such an optional embodiment a player may change wager denomination only when the full map is used. One purpose of such optional wager and wager denomination restrictions is to control the house edge as game event outcomes are excluded from play.

Returning to the optional embodiment of FIG. 1 in one optional embodiment, a system or electronic game machine may be configured to detect a triggering element for a re-mapping. That is, in one optional embodiment, additional game event outcomes are produced using the continuously modified map until a triggering element for a re-mapping is detected 314. The triggering element for the re-mapping may be based on the production of a game event outcome (such as a game event outcome containing a specific re-mapping symbol or card), the receipt of input through the player interface 108 (such as a player request for re-mapping), the conditions of the map (such as making a specific quantity of game event outcomes unavailable or the production of a specific quantity of game event outcomes), or a combination thereof. In one optional embodiment, multiple triggering elements may be defined, with a re-mapping occurring in response to whichever occurs first. For example, a triggering element may include the receipt of input through the player interface 108 triggering a re-mapping. Similarly, another triggering element may include the modification of the map to make a predetermined quantity of game event outcomes unavailable and/or the production of a predetermined quantity of game event outcomes. Thus, in an embodiment in which multiple triggering elements are defined, the player may trigger a re-mapping or may wait until a re-mapping automatically occurs after a certain quantity of game event outcomes are produced and/or the modified map has a certain quantity of game event outcomes unavailable.

In an optional embodiment, an triggering element may be calculated and fixed from game to game. Thus, in one such optional embodiment, after each re-mapping of the map (as described in greater detail below), a triggering element for an automatic re-mapping is determined for the reconstituted map at a fixed point. The fixed point for the automatic re-mapping may be determined in any number of ways, and may be based on any number of factors. For example, in one optional embodiment, the fixed point may be determined to be the point at which a desired house edge is obtained.

In an optional embodiment directed for use in a multi-player game, each player may be able to manually trigger a re-mapping. However, in another optional embodiment for multi-player games, only one player is eligible to manually trigger a re-mapping on any game event outcome. In a further optional embodiment, the eligibility to manually trigger a re-mapping rotates among the players.

Upon a re-mapping, the unavailable game event outcomes are restored 316 to the map. In other words, the full map is available in a game event conducted immediately after a re-mapping.

In one example, the present invention may be used to conduct a slot game. In one such example, each possible game event outcome is mapped to a signal received at the logic controller 102 from an RNG. A simplified example of such a complete map is illustrated in Table 1.

TABLE 1

| Random Number | Game Event Outcome |
|---|---|
| 000001 | 7-7-7 |
| 000002 | 7-7-BAR |
| 000003 | 7-BAR-7 |
| 000004 | BAR-7-7 |
| . | . |
| . | . |
| . | . |
| 999999 | BAR-BAR-BAR |

In play, an RNG may produce, for example, the random number 000002. This random number is mapped to a particular game event outcome 7-7-BAR according to the example map of Table 1. The logic controller 102 controls the display 104 to display the mapped outcome (i.e., 7 on the first reel, 7 on the second reel, and BAR on the third reel). The logic controller 102 modifies the map to make the game event outcome mapped to 000002 unavailable. For example, Table 2 illustrates a simplified version of such a modified map.

TABLE 2

| Random Number | Game Event Outcome |
|---|---|
| 000001 | 7-7-7 |
| 000002 | Unavailable |
| 000003 | 7-BAR-7 |
| 000004 | BAR-7-7 |
| . | . |
| . | . |
| . | . |
| 999999 | BAR-BAR-BAR |

As seen in the example of Table 2, the game event outcome correlated with the random number 000002 is unavailable. In such an optional embodiment, receipt of a signal from the RNG representing the random number 000002 could cause the logic controller 102 to request a new random number from the RNG. Alternatively, the random number 000002 could be redirected to a different game event outcome. In either case, the game event outcome associated with 000002 in the complete map would be unavailable in the modified map.

Figure 5:
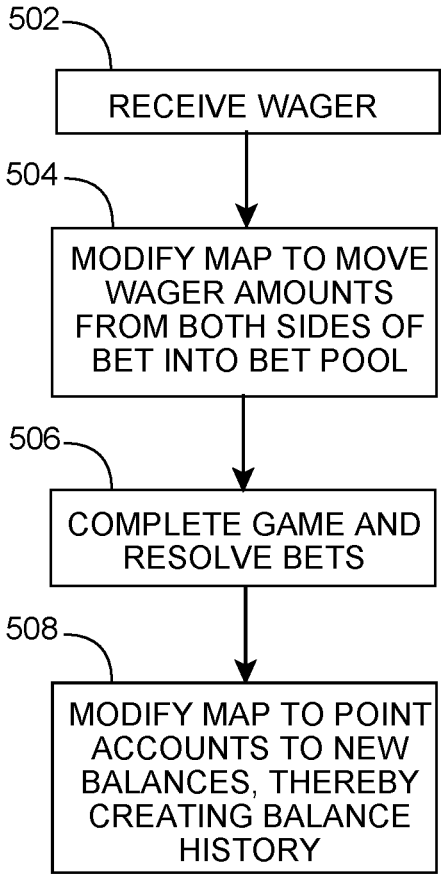
FIG. 5 is a flow chart of a method according to an embodiment of the present invention.

In another optional embodiment, illustrated in FIG. 5, the present invention may be applied to other forms of data. For example, in a financial setting, a map may correlate accounts with a balance. However, as may be appreciated, money is not created or destroyed; rather, it is only moved between or among multiple accounts. Thus, the same process may be used with financial data in which a map correlating accounts with balances may be modified upon a transaction so that the accounts involved in the transaction are mapped to a different balance after the transaction representing the new balance.

Such a method may be used for the accounts of any depository bank. For example, in a transaction in which money is transferred from one account to another account (e.g., one bank customer is paying another bank customer) the map correlating each account to its balance would be modified so that one account is remapped to a different lower balance after the amount is transferred from that account, while the map is likewise modified so that another account is re-mapped to a different higher balance after the amount is transferred into that account.

In another example of such an optional embodiment, would be the electronic cash-backed casino bank of two or more participant in a gambling transaction. Under state gaming law there must be cash on hand for each table or electronic machine to pay all jackpots for thirty straight days. Thus, each table or electronic gaming machine is a regulated cash bank. Rather than using hoppers, casinos use a credit slip to be cashed-in to represent the conversion of cash into electronic currency. As a result, the credit slip affects the electronic bank record of an electronic gaming machine on every transaction. When bets are made 502, the map of accounts and balances is modified 504. Specifically, the map is modified so that an account associated with each side of the bet (player versus player, or player versus house) points to a different lower balance associated with the removal of the bet amount. Simultaneously, the map is modified so that an account associated with a betting pool points to a different higher balance as each account "moves" electronic currency credits into the betting pool. After resolution of the game 506, the map is modified 508 so that the account associated with the betting pool is cleared and accounts associated with winners (whether a player or the house) point to a different higher balance to reflect the winnings. Even a push game action requires both sides to get cash back into accounts that affects their electronic currency cash bank.

As a result, the sequence of transactions, optionally kept in a record block, are kept and sent to back office. When a transaction is over, e.g., a player leaves a table or machine, the map may be re-mapped to show full accessible cash banks.

While certain embodiments of the present invention have been shown and described it is to be understood that the present invention is subject to many modifications and changes without departing from the spirit and scope of the claims presented herein.

We claim:

1. An electronic game machine configured to conduct a plurality of game events, each game event capable of producing at least one game event outcome from a plurality of possible game event outcomes, comprising:

a logic controller;

a player interface in communication with said logic controller, wherein said player interface includes a hardware-based currency acceptor and said player interface is configured to receive input and transmit said input to said logic controller;

a display in communication with said logic controller; and a data storage device configured to store in non-volatile memory a complete map containing a plurality of possible signals capable of being received at said logic controller correlated to all said possible game event outcomes and program instructions executable by said logic controller to conduct the steps of:

receiving currency credits through said currency acceptor of said player interface;

communicating between said currency acceptor and said logic controller to indicate receipt of said currency credits;

conducting a game event in response to at least (a) said receipt of a wager, deducted from said currency credits, through said player interface and (b) a signal received at said logic controller from said plurality of possible signals to produce a game event outcome, wherein said game event outcome is produced by selecting said game event outcome correlated to said signal received according to said complete map stored at said data storage device;

resolving said wager based on said at least one game event outcome produced;

modifying said complete map by making each said game event outcome produced unavailable from all said plurality of possible game event outcomes according to said complete map stored at said data storage device, wherein all said plurality of possible game event outcomes remain in said modified complete map;

receiving at least one additional wager after modifying said complete map stored at said data storage device;

conducting at least one additional game event to produce an additional game event outcome using said modified complete map; and resolving said at least one additional wager based on said additional game event outcome produced using said modified complete map.

2. The electronic game machine of claim 1 wherein said signal comprises input received through said player interface and transmitted to said logic controller.

3. The electronic game machine of claim 1 further comprising a random number generator in communication with said logic controller, wherein said signal comprises a random number generated by said random number generator and transmitted to said logic controller.

4. The electronic game machine of claim 1 wherein said step of modifying said complete map comprises de-mapping said at least one game event outcome produced to make said at least one game event outcome produced unavailable to be selected from said modified complete map while remaining in said modified complete map.

5. The electronic game machine of claim 1 wherein said step of modifying said complete map comprises restructuring said complete map such that said signal correlated said at least one game event outcome produced becomes correlated to a different game event outcome in said modified complete map while remaining in said modified complete map.

6. The electronic game machine of claim 1 wherein said program instructions further comprise:

detecting a triggering element; and re-mapping said modified complete map into said complete map to include previously excluded game event outcomes within said complete map in response to detection of said triggering element.

7. The electronic game machine of claim 6 wherein said triggering element is the production of a specified game event outcome.

8. The electronic game machine of claim 6 wherein said triggering element is receipt of input through said player interface.

9. The electronic game machine of claim 6 wherein said triggering element is production of a specified quantity of game event outcomes.

10. The electronic game machine of claim 6 wherein said triggering element is making a specified quantity of game event outcomes unavailable.

11. A system configured to conduct a plurality of game events, each game event capable of producing at least one game event outcome from a plurality of possible game event outcomes, comprising:

a network device configured to store in non-volatile memory a complete map containing a plurality of possible signals correlated to all said possible game event outcomes;

an electronic game machine in communication with said network device comprising:

a logic controller;

a player interface in communication with said logic controller, wherein said player interface includes a hardware-based currency acceptor and said player interface is configured to receive input and transmit said input to said logic controller;

a display in communication with said logic controller; and a data storage device configured to store program instructions executable by said logic controller to conduct the steps of:

receiving currency credits through said currency acceptor of said player interface;

communicating between said currency acceptor and said logic controller to indicate receipt of said currency credits;

conducting a game event in response to at least (a) said receipt of a wager, deducted from said currency credits, through said player interface and (b) a signal received at said logic controller from said plurality of possible signals to produce a game event outcome, wherein said game event outcome is produced by selecting said game event outcome correlated to said signal received according to said complete map stored at said network device;

resolving said wager based on said at least one game event outcome produced;

modifying said complete map by making each said game event outcome produced unavailable from said plurality of possible game event outcomes according to said complete map stored at said network device, wherein all said plurality of possible game event outcomes remain in said modified complete map;

receiving at least one additional wager after modifying said complete map stored at said network device;

conducting at least one additional game event to produce an additional game event outcome using said modified complete map; and resolving said at least one additional wager based on said additional game event outcome produced using said modified complete map.

12. The system of claim 11 wherein said signal comprises input received through said player interface and transmitted to said logic controller.

13. The system of claim 11 further comprising a random number generator in communication with said logic controller, wherein said signal comprises a random number generated by said random number generator and transmitted to said logic controller.

14. The system of claim 11 wherein said step of modifying said complete map comprises de-mapping said at least one game event outcome produced to make said at least one game event outcome produced unavailable to be selected from said modified complete map while remaining in said modified complete map.

15. The system of claim 11 wherein said step of modifying said complete map comprises restructuring said complete map such that said signal correlated said at least one game event outcome produced becomes correlated to a different game event outcome in said modified complete map while remaining in said modified complete map.

16. The system of claim 11 wherein said program instructions further comprise:

detecting a triggering element; and re-mapping said modified complete map stored at said network device into said complete map to include previously excluded game event outcomes within said complete map in response to detection of said triggering element.

17. The system of claim 16 wherein said triggering element is the production of a specified game event outcome.

18. The system of claim 16 wherein said triggering element is receipt of input through said player interface.

19. The system of claim 16 wherein said triggering element is production of a specified quantity of game event outcomes.

20. The system of claim 16 wherein said triggering element is making a specified quantity of game event outcomes unavailable.

* * * * *